United States Patent [19]

Kupersmit

[11] Patent Number: 4,531,670

[45] Date of Patent: Jul. 30, 1985

[54] COMBINATION CLIP AND SEAL CONSTRUCTION FOR SHIPPING CONTAINERS

[76] Inventor: Julius B. Kupersmit, 299 W. 12th St., New York, N.Y. 10014

[21] Appl. No.: 621,802

[22] Filed: Jun. 18, 1984

[51] Int. Cl.[3] ..... B65D 45/00

[52] U.S. Cl. ..... 229/45 R; 220/4 F; 206/807

[58] Field of Search ..... 229/45 R; 220/4 R, 4 F; 206/600, 807

[56] References Cited

U.S. PATENT DOCUMENTS

| | | | |
|---|---|---|---|
| 3,875,843 | 4/1975 | Maeda et al. | 229/45 R |
| 3,949,929 | 4/1976 | Kupersmit | 206/807 |
| 4,019,764 | 4/1977 | Okamura | 229/45 R |
| 4,167,242 | 9/1979 | Kupersmit | 229/45 R |
| 4,239,149 | 12/1980 | Kupersmit | 229/45 R |

*Primary Examiner*—Joseph Man-Fu Moy

*Attorney, Agent, or Firm*—Charles E. Temko

[57] ABSTRACT

A combination assembly clip and sealing means for collapsible shipping containers. The clip is formed from synthetic resinous materials, and may be partially folded to enable it to be inserted into a pair of aligned openings in an assembled container to maintain, for example, a lid in closed condition upon a side wall thereof. After insertion, the clip is returned to planar condition to fully engage the side of the engaged openings in the container. This movement aligns a plurality of exposed openings in the clip through which a strip-type seal is inserted and closed, thus making it impossible to refold the clip prior to removal to open the container without first destroying the seal.

2 Claims, 5 Drawing Figures

COMBINATION CLIP AND SEAL CONSTRUCTION FOR SHIPPING CONTAINERS

BACKGROUND OF THE INVENTION

This invention relates generally to the field of collapsible large size shipping containers, and more particularly to an improved form of synthetic resinous clip adapted to perform the joint functions of closing the lid upon a main body of the container, and effecting a seal which prevents removal of the clip until the seal is breached, thereby providing a means for indicating the presence of tampering. Reference is made to my prior U.S. Pat. No. 4,239,149 granted Dec. 16, 1980, the present invention relating to improved structure thereover.

The problem of pilferage of large shipping containers is well known, irrespective of the form of transportation employed. Where the shipping containers are formed of relatively light-weight materials, such as heavy-grade corruagted board, it has been common practice to provide a seal-retaining means in the form of a metal stamping which is engaged upon an inner edge of a main body portion of the container, and which projects through an opening in the lid to be engaged by a frangible seal. To remove the lid from the main body of the container, it is necessary to destroy the seal. In the case of an unauthorized opening, the presence of tampering is immediately revealed.

To facilitate a rapid and convenient securing of the lid upon the container, there have already been developed in the art a plurality of expandable type clips, usually formed of molded synthetic resinous materials which are of an overall expanded size and configuration corresponding to a pair of alignable openings in portions of the lid and the main body of the container. When the container is closed by placing the lid in position, opening in the lid and container are thereby aligned, and the expandable clip is inserted in unexpanded condition to be thereafter expanded to grip the edges of the openings in both parts of the container, and maintain such parts in abutted relation. In one form of clip, there are two separable elements, one of which fits into the other to expand the outer elements to the above described condition. Another type is formed integrally to include a pair of sections foldable about a transversely extending fold line to move the clip between contracted and expanded conditions.

In my above mentioned prior patent there is disclosed a provision for sealing the clip in expanded condition using a flat metallic strip type seal.

While this construction has proved to be satisfactory, the above described seal is relatively expensive, and is of course, not reusable. Since the issuance of the above patent there has become available a molded synthetic resinous seal which cost only a fraction of the cost of the metallic seal. Because of the configuration of the new seal, its use in my earlier construction permits the clip to be partially open without rupture, thereby providing the possibility of undetected tampering.

SUMMARY OF THE INVENTION

Briefly stated, the invention contemplates the provision of a flexible molded clip of the class described, adapted to penetrate the aligned openings in a pair of abutted parts of a shipping container, and engage the edges of said opening when the clip is in expanded condition. Upon movement to such expanded condition, a plurality of openings in the clips themselves are placed in aligned relation to permit insertion of a standard metallic strip-type seal, the ends of which are permanently interconnected, so that it is necessary to cut the strip and disengage it from the aligned openings in the clip before the clip can be disengaged from the aligned openings in the container, whereby the container is opened. Should the seal be tampered with, the presence of pilfering is immediately indicated. The improved clip comprises an alignable second plurality of openings of smaller configurations enabling the substituted use of narrow synthetic resinous type seals, the second plurality of openings being so located as to allow only minimum folding of the clip from planar condition without providing evidence of tampering.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
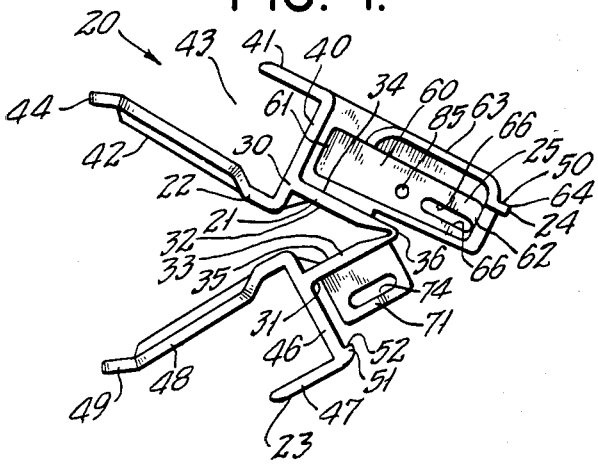
FIG. 1 is a side elevational view of a first embodiment of the invention.

In accordance with the invention, reference is made to my above identifed prior patent for a description of the environs of the disclosed embodiments in installed condition, which are fully interchangeable with those disclosed in said patent.

Referring to the drawings in the present application, reference character 10 (see FIG. 5) indicates a shipping container including side wall, one of which is indicated by reference character 11, and a lid or cover element 12. A rectangular opening 16 penetrates the lid element 12 and a corresponding rectangular opening 17 penetrates the side wall 11, the opening 16 and 17 being in congruent relation when the container is closed.

Figure 5:
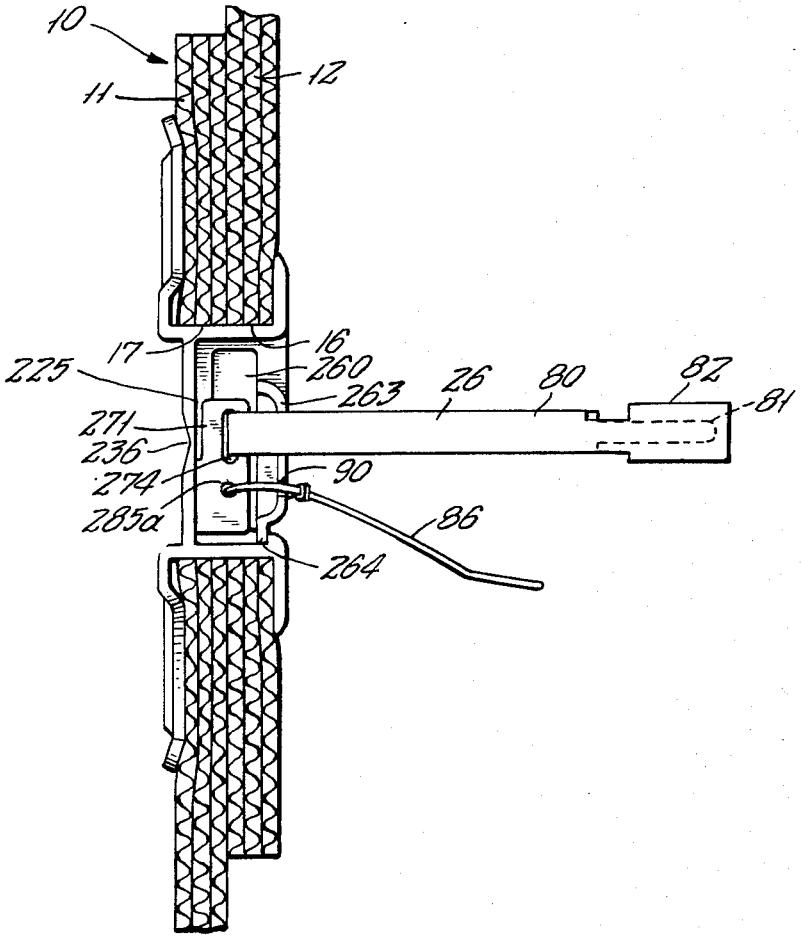
FIG. 5 is a side elevational view of the third embodiment, partly in section, showing the third embodiment in installed condition within a pair of aligned openings in a shipping container.

Referring to FIG. 1, reference character 20 designates generally a first embodiment of a clip element, a plurality of such clip elements being used to close the container 10. The clip elements are generally similar, each including a planar main wall 21 carrying first and second channel elements 22 and 23, respectively, a latching means 24, and a sealengaging means 25 selectively engaged by a seal element 26. (FIG. 5).

The wall 21 is of generally rectangular configuration, and is bounded by transverse edges 30 and 31, side edges 32 and 33, an inner surface 34, and an outer surface 35. A fold edge 36 of thinned cross-section extends between the side edges 32–33 .

The first channel element 22 includes a bottom wall 40 communicating with the edge 30, an inner flange 41 and an outer flange 42 which define an interstice 43 into which the abutted walls of the container 10 are fitted. The outer flange 42 includes a camming member 44 to facilitate engagement of these walls when the clip element is expanded.

Correspondingly, the lower channel elements 23 includes a bottom wall 46 an inner flange 47 and an outer flange 48, the inner flange 47 including a camming member 49. The wall 46 also forms a locking ledge 51 cooperating with a second locking ledge 50 which forms a groove 52.

The latching means 24 includes a generally planar member 60 having first and second ends 61 and 62, and supports a manually engagable member 63 having a projecting tip 64 which engages the groove 52 when the clip element 20 is pushed from a position shown in FIG. 1 to the position shown in FIG. 5 at the time of installation.

The fold edge 36 thus forms first and second relatively movable sections which permits the clip element to be folded, so as to diminish in size and permit its insertion for installation into openings 16 and 17 in the container.

The seal engaging means 25 includes a pair of walls, one of which is indicated by reference character 71 in FIG. 1, in each of which there is a slot 74. When the clip is in expanded condition, the slots 74 are aligned with the slot 66 in the planar member 60. FIG. 1 illustrates a second opening 85 the purpose of which will be described herein below.

Figure 2:
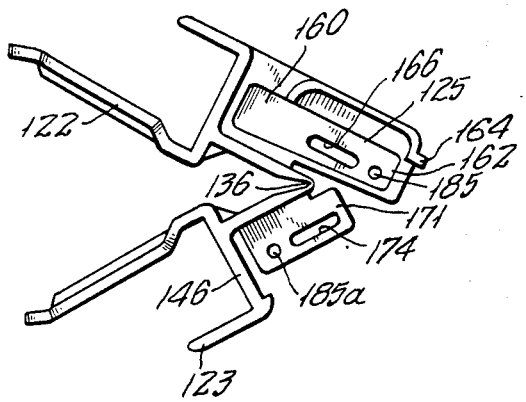
FIG. 2 is a side elevational view of a second embodiment of the invention.

Turning now to the second embodiment of the invention, illustrated in FIG. 2, to avoid needless repetition, parts corresponding to those first embodiment have been designated by similar reference characters with the additional prefix "I".

In the second embodiment, the position of slot 166 and opening 185 in member 160 are reversed, the opening 185 being placed adjacent to the end 162 of planar member 160. Walls 171 are also extended, and slots 174 are placed further from wall 146, leaving space for the addition of openings 185*a*. When the clip is in its extended expanded condition, slots 174 are aligned with slot 166 and openings 185*a* are aligned with opening 185.

Turning now to the third embodiment of the invention, parts corresponding to those of the first embodiment have been designated by similar reference characters with the additional prefix "2".

Figure 3:
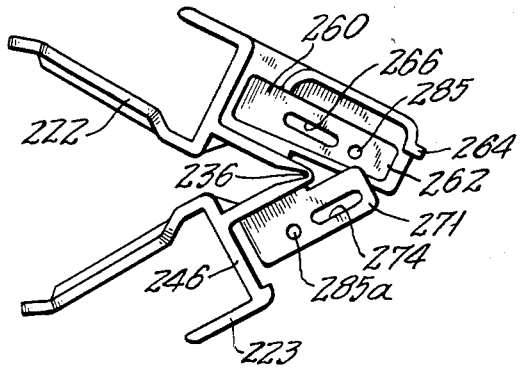
FIG. 3 is a side elevational view of a third embodiment of the invention.

In the third embodiment shown in FIG. 3, the walls 271 are further extended and the location of the slotted openings 274, and the smaller openings 285*a* are moved further from the bottom wall 246. In channel element 222, slot 266 and opening 285 are both moved to a position further from end 262 of member 260. This allows less free movement between the upper and lower parts of the device without damage to the seal.

Figure 4:
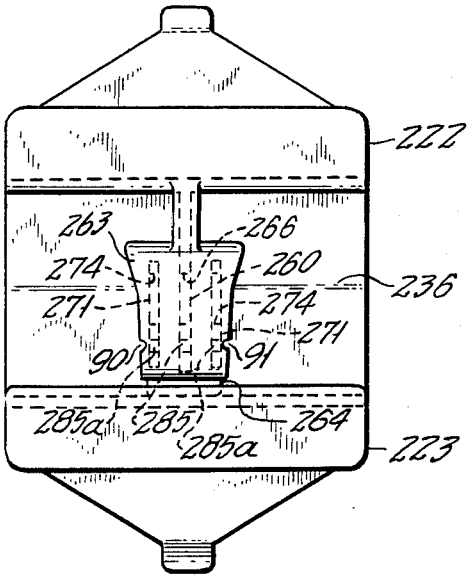
FIG. 4 is a front elevational view of the third embodiment.

As shown in FIGS. 4 and 5, when the clip is in expanded condition, the slots 274 in the walls 271 are aligned with slot 266 in the planar member 260. The same is true of slots 74 and 66 of the first embodiment, and of slots 174 and 166 in the second embodiment. One form of seal 26 that can, thus, be used in all embodiments of the invention is of well known type, including a length of metal 80 which is threaded through the two slots 274 and the slot 266, and a first end of which is insertable into a deformable member on a second end 82, following which the member 82 is compressed to secure the first end 81 therein. This operation makes it impossible to move the clip 20 to a position which permits removal from engagement with the container 10. This movement is possible only by rupturing the length of metal 80 at some point along the enclosed loop which forms the seal, and where such operation is unauthorized, the occurrence of tampering and/or pilfering is immediately apparent.

In all of the embodiments, it is also possible to use a filament seal 86 (FIG. 5) in lieu of seal 26. In the first embodiment the filament seal 86 is threaded through opening 85 in member 60 and through slots 66 and 74 in walls 71. In the second embodiment, it is threaded through openings 185*a* in walls 171 and through openings 185 in member 160. In the third embodiment it is similarly threaded, although in this case, the free movement between the upper and lower parts of the device is restricted by the openings 285*a* and 285 being positioned at a greater distance from wall 246 and end 262.

This movement is still further restricted by the provision of recesses 90 and 91 in the member 263 immediately adjacent the openings 285*a–285* which permit the loop portion of the seal 86 to be reduced in girth. There is thus afforded a choice of seals for use with a single clip device.

It will be apparent that by means of a relatively minor modification to a known clip structure, it is possible to incorporate one of several types of sealing means at the election of the user. In one embodiment, only a single additional opening is necessary. In the other embodiments, the provisions of additional alignable smaller openings facilitates installation, and makes tampering more difficult.

I wish it to be understood that I do not consider the invetnion limited to the precise details of structure shown and set forth in this specification, for obvious modifications will occur to those skilled in the art to which the invention pertains.

I claim:

1. In a combination container and cover therefore having a pair of selectively abuttable walls having aligned openings therein, and an expandable clip simultaneously engaging the edges of said aligned openings to maintain said walls in abutted relation, said clip having first and second sections relatively movable between a first position in which the overall size of the clip is relatively diminished and a second position in which the overall size is relatively enlarged to engage said edges of said openings in said container about a transversely extending pivotal axis, said clip having a plurality of openings therein which are placed in alignment when said clip is in said second position; and elongated seal means penetrating said last-mentioned openings to prevent movement of said sections from said second position, the improvement comprising: said clip having a plurality of alignable sets of openings of different configuration, whereby, at the option of the user, seals of different configuration may be selectively engaged in one of said alignable sets of openings.

2. The improvement in accordance with claim 1, further characterized in the location of the smaller said sets of openings being most distally located from said pivotal axis.

* * * * *